US005133091A

United States Patent [19]

del Valle Mas

[11] Patent Number: 5,133,091

[45] Date of Patent: Jul. 28, 1992

[54] SOCK WITH AN INTEGRALLY FORMED POCKET

[76] Inventor: Maria E. del Valle Mas, 6421 SW. 72nd Ct., Miami, Fla. 33143

[21] Appl. No.: 667,022

[22] Filed: Mar. 11, 1991

[51] Int. Cl.[5] ..... A41B 13/00

[52] U.S. Cl. ..... 2/239; 2/247; 2/252

[58] Field of Search ..... 2/239, 247, 61, 243 R, 2/242, 248, 252, DIG. 6, 249, 250, 251

[56] References Cited

U.S. PATENT DOCUMENTS

| | | | |
|---|---|---|---|
| 767,381 | 8/1904 | Brown | 2/239 |
| 790,595 | 5/1905 | Scott | 2/239 |
| 1,112,805 | 10/1914 | Kaufman | 2/239 |
| 1,128,941 | 2/1915 | Brown | 2/239 |
| 1,238,196 | 8/1917 | Rodelheim | 2/239 |
| 2,814,807 | 12/1957 | Dollar | 2/239 |
| 4,005,494 | 2/1977 | Burn | 2/239 |
| 4,038,699 | 8/1977 | Burn | 2/239 |
| 4,445,233 | 5/1984 | Rubin | 2/239 |
| 4,961,235 | 10/1990 | Willinger | 2/239 |

FOREIGN PATENT DOCUMENTS

| | | | |
|---|---|---|---|
| 288983 | 2/1939 | Fed. Rep. of Germany | 2/239 |
| 1804189 | 7/1970 | Fed. Rep. of Germany | 2/239 |
| 2743741 | 10/1976 | Fed. Rep. of Germany | 2/239 |
| 391916 | 11/1908 | France | 2/239 |
| 2344238 | 3/1976 | France | 2/239 |
| 2363292 | 9/1976 | France | 2/239 |
| 2631522 | 5/1988 | France | 2/239 |
| 2633809 | 7/1988 | France | 2/239 |
| 1561252 | 3/1977 | United Kingdom | 2/239 |

*Primary Examiner*—Werner H. Schroeder
*Assistant Examiner*—Amy Brooke Vanatta
*Attorney, Agent, or Firm*—Malloy, Downey & Malloy

[57] ABSTRACT

A sock having a cuff portion with an inner and outer layer disposed in overlying relation and including a pocket integrally formed therebetween having an opening near a top edge of the cuff. A seam extending downwardly on opposite sides of the opening and along a bottom of the cuff defines the boundaries of an interior of the pocket. A hook and loop-type fastener attached on opposite, opposing surfaces of the pocket's interior, adjacent the opening, serves to releasably secure the opening in a closed, sealed position.

7 Claims, 1 Drawing Sheet

SOCK WITH AN INTEGRALLY FORMED POCKET

BACKGROUND OF THE INVENTION

1. Field of the Invention

The present invention relates generally to a sock having a pocket integrally formed within a cuff portion thereof, the pocket being adapted to carry such items as credit cards, keys, money and the like therein.

2. Description of the Related Art

It has been generally known to provide various types of pockets or other storage means in hosiery articles such as socks for carrying money and other items which for various reasons cannot be carried in pants pockets, a purse, or other such locations in which such articles are normally carried. A common characteristic associated with these socks in the related art is the separate attachment of the pocket to the sock such that the pocket is readily visible and actually extends or hangs freely from the leg portion of the sock. This type of construction is generally undesirable because the pocket is readily visible when worn on the user even if the pocket is empty. This is due to the fact that the added material which makes up the pocket portion causes a bulge in the sock on the wearer's ankle or lower leg. The separate construction of the pocket further causes discomfort to the wearer when articles such as keys or coins are stored therein. Another problem associated with the pockets on the socks in the related art is the tendency of the pocket to tear at the point where the pocket is attached to the sock whether the pocket is sewn thereto or integrally knitted with the sock during manufacture.

Included in the related art are the U.S. patents to Burn, U.S. Pat. No. 5,038,699 and 4,005,494 which are directed to a pocket sock wherein the pocket is integrally knitted with the leg portion of the sock and extends freely therefrom.

The patent to Roedelheim, U.S. Pat. No. 1,238,196 discloses a stocking having a pocket sewn to a top portion thereof, wherein the pocket includes a laced opening which is readily visible when worn on the user.

Another pocket sock in the related art is seen in the patent to Rubin, U.S. Pat. No. 4,445,233 which discloses a pocket structure sewn to an inner surface of a sock and having a vertical zipper opening extending downwardly along its length. The pocket in the Rubin sock is also readily visible and considerably bulky when worn on the user. The vertical zipper in Rubin must be maintained in a closed position to prevent the contents from spilling out.

With the foregoing in mind, it is an object of the present invention to provide a sock having a pocket integrally formed between an outer layer and an inner layer of a cuff portion thereof, wherein items such as credit card, keys, money and the like can be stored therein.

It is a further object of the present invention to provide a sock with an integrally formed pocket in the cuff portion thereof, wherein the pocket is not readily visible when the sock is either removed or worn on the user.

It is still a further object of the present invention to provide a sock having an integrally formed pocket in a cuff or leg portion thereof which does not require additional material to be added to the sock, thereby providing maximum comfort when worn on the user.

It is yet another object of the present invention to provide a sock having an integrally formed pocket therein, wherein the sock can be made of any generally known material for men, women, or children in either a dress-type sock or athletic sock.

It is finally an object of the present invention to provide a sock having an integrally formed pocket therein which is relatively simple and inexpensive to manufacture, thereby making the sock more marketable.

These and other objects and advantages of the present invention will be more readily apparent in the description which follows.

SUMMARY OF THE INVENTION

The present invention relates to a sock having a pocket integrally formed between an inner and outer layer of a cuff or leg portion thereof, wherein the pocket is not readily visible when either worn or removed from the user's foot.

An opening or mouth of the pocket is located in close, spaced relation to a top open end of the sock on either an outer surface or an inner surface, the mouth being specifically structured and configured to allow removable receipt of such articles such as credit cards, health club membership cards, keys, jewelry, money, and the like therein. The boundaries of the pocket interior are defined by two side seams which extend downwardly from opposite ends of the mouth and a bottom seam which extends between and connects the side seams in spaced relation below the mouth. The side seams and the bottom seam connect the outer layer and inner layer of the cuff so that items placed within the pocket interior will not migrate into other areas of the cuff.

The mouth includes an added layer of reinforcing material sewn to an inner surrounding surface thereof adding strength and partial rigidity thereto so as to prevent tearing or deformation of the mouth when the cuff or leg portion is stretched about the wearer's leg or ankle. A hook and loop-type fastener is attached on opposite opposing inner surfaces adjacent the mouth so that the mouth can be moved between an open position and a closed, sealed position.

The reinforcing material and/or hook and loop fasteners can be of the same color as the sock or of a different color or pattern to add to the overall appearance of the sock.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature of the present invention, reference should be had to the following detailed description taken in connection with the accompanying drawings, in which.

Like reference numerals refer to like parts throughout the several views of the drawings.

DETAILED DESCRIPTION OF THE PREFERRED EMBODIMENT

Figure 1:
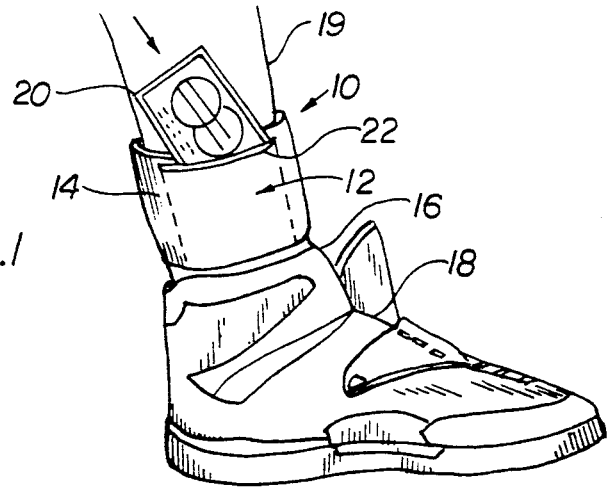
FIG. 1 is a perspective view of the sock of the present invention as worn by a user.

With reference to FIG. 1, the present invention relates generally to a sock 10 having a integrally formed pocket 12 formed in a cuff or leg portion 14 thereof. The sock 10 can be of any suitable material and of either a dress-type sock or athletic sock for men, women, or children. In FIG. 1, an athletic sock is shown worn by a person during athletic or exercise activities such as aerobics, weightlifting, racketball, basketball, and the like. The cuff portion 14 of the sock 10 of the present invention normally extends upwardly beyond the top 16 of the wearer's shoe 18 in covering relation to the wearer's ankle or lower leg 19. As illustrated in FIG. 1, the pocket 12 is specifically designed to hold such items as credit cards or membership cards 20 therein when exercising at a health club. Because most athletic wear, especially women's aerobic attire, does not include pockets to hold such items as athletic club membership cards 20 or keys, money, jewelry or the like, the pocket 12 in the sock 10 of the present invention is an ideal location for storage of such items. A mouth 22 of the pocket 12 is specifically designed to allow easy access to the pocket for placement and removal of the items desired to be stored therein.

Figure 3:
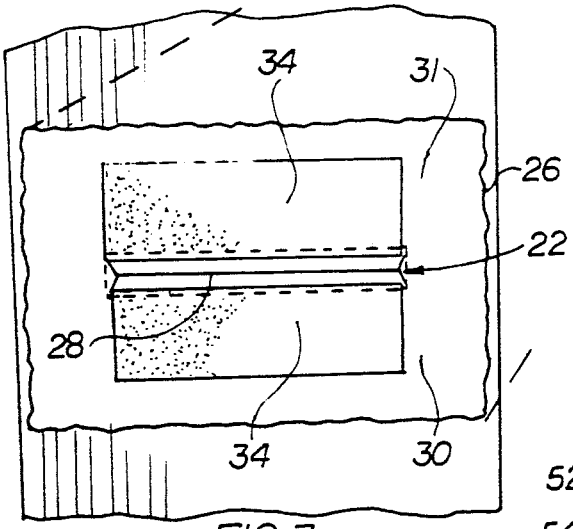
FIG. 3 is a isolated plan view of the pocket opening of FIG. 2.

The construction of the mouth 22 of the pocket 12 is illustrated in FIG. 3 and includes a generally rectangular patch of reinforcing material 26 sewn to an inner surface of the leg portion 15 of the sock 10. An opening 28 is cut through the reinforcing material 26 and leg portion 15. Once the opening 28 has been cut, a pair of oppositely disposed flap portions 30 and 31 are formed which will eventually be disposed on opposite interior surfaces of the mouth 22. Hook and loop-type fasteners 34 are mounted to the flap portions 30 and 31 to form a securing means allowing releasable securing of the mouth 22 between an open and a closed, sealed position.

Figure 2:
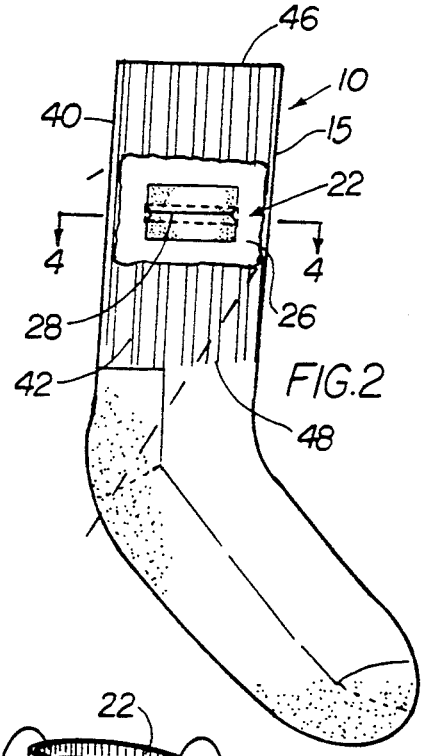
FIG. 2 is a side plan view of the sock of the present invention illustrating the construction of a pocket opening thereof.
Figure 5:
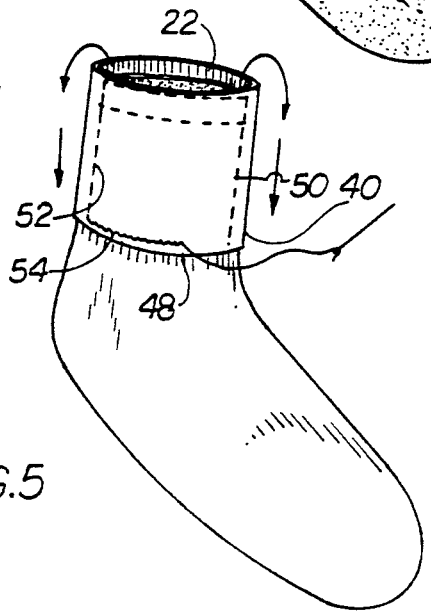
FIG. 5 is a perspective view illustrating the method of construction of the pocket in the cuff or leg portion of the sock.

Once the opening 28 is cut and the hook and loop fasteners 34 are attached, the leg portion 15 is folded down as illustrated in FIG. 5 so that a top portion 40 of the leg portion 15 overlaps a bottom portion 42, as seen in FIGS. 2 and 5. A top distal rim 46 of the top portion 40 is aligned with a lower edge 48 of the bottom portion 42.

The boundaries of the interior of the pocket 12 are defined by opposite side seams 50 and 52 extending downwardly from opposite ends of the mouth 22 and a bottom seam 54 extending between the opposite side seams 50 and 52. The side seams 50 and 52 and bottom seam 54 attach the top portion 40 to the bottom portion 42. The overlapping top and bottom portions 40 and 42 of the cuff 14 define an outer layer and an inner layer of the cuff 14 respectively.

Figure 4:
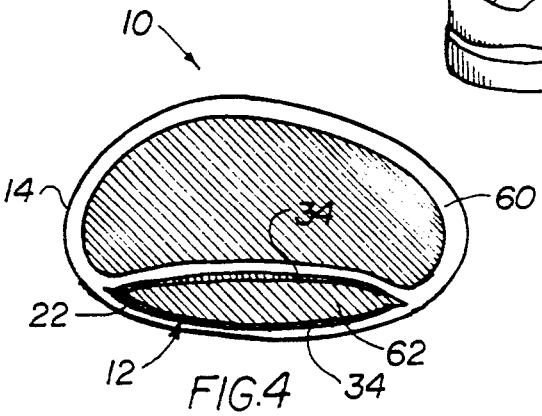
FIG. 4 is a top plan view of a top opening of a cuff of the sock with the pocket and pocket opening integrally formed therewith.

With reference to FIG. 4, the mouth 22 is shown integrally formed near a top edge 60 of the cuff 14 wherein the hook and loop fasteners 34 are disposed in opposite, opposing relation on an inner surface within the interior of the pockets 12. It is important to note that the mouth 22 can be located on the inner side or the outer exposed side of the cuff 14. On the inner side, the mouth 22 is hidden from normal view, thus giving the appearance of a regular sock.

Now that the invention has been described,

What is claimed is:

1. A sock comprising:

a foot portion, an ankle portion, and a cuff portion integrally knitted and formed so as to fit over a foot and at least a lower leg of a wearer in covering relation thereto, said cuff portion including an outer layer and an inner layer disposed in overlying relation to one another and attached to one another about an upper peripheral rim and a lower edge, adjacent said ankle portion, a pocket integrally formed within said cuff portion between said outer layer and said inner layer and including a mouth disposed in close, spaced relation to said upper peripheral rim on said inner layer, said mouth being structured and disposed to allow access to an interior of said pocket;

reinforcing means sewn about an interior of said mouth for providing strength thereto and preventing tearing or deforming of said mouth upon said stretching of said cuff portion, securing means attached to opposite surfaces of said interior of said pocket adjacent said mouth and structured and disposed for releasably securing said mouth in in a closed, substantially sealed position relative to said interior, and, said reinforcing means including a layer of reinforcing material sewn about said mouth and including a pair of inner flap portions disposed on opposite sides of said mouth within said interior of said pocket, said flap portions normally disposed in confronting, abutting relation when said mouth is in said closed position.

2. A sock according to claim 1 wherein said interior of said pocket includes two opposite sides and a bottom defined by a seam extending downwardly on opposite sides of said mouth and along said lower edge of said cuff portion connecting said outer layer to said inner layer.

3. A sock according to claim 2 wherein said mouth and said interior of said pocket are sized and configured to allow removable receipt of a credit card therein.

4. A sock according to claim 3 wherein said mouth and said interior of said pocket are sized and configured to allow removable receipt and storage of paper currency, coins, keys and jewelry therein.

5. A sock according to claim 4 wherein said securing means is attached to an exposed surface of said flap portions being structured and disposed to releasably secure said mouth in said closed position.

6. A sock according to claim 5 wherein said securing means comprises a hook and loop-type fastener attached to said flap portions structured and disposed thereon so as to releasably fasten and secure said mouth in said closed, substantially sealed position.

7. A method of forming an integrally formed pocket in a sock of the type having a foot portion, an ankle portion, and a cuff and adapted to be worn over the foot, ankle and at least a lower leg of a wearer, said method comprising the steps of:

folding over the cuff such that a top portion of the cuff is disposed in overlying relation to a bottom portion of the cuff with an outer surface of said top portion being readily exposed, attaching a patch of reinforcing material near a top edge of the folded cuff, marking the reinforcing material to indicate an opening location by means of a straight line terminating a substantially V-shaped formation at opposite ends, sewing said reinforcing material to said top portion of the cuff about said opening location, cutting an opening through said reinforcing material and said top portion in close, spaced relation to said top edge at said marked opening location, turning the sock inside out, pulling said reinforcing material through said opening, sewing said opening on said opposite sides so as to strengthen and reinforce the attachment of said reinforcing material to opposite sides of said opening, attaching a hook and loop fastener to said reinforcing material on said opposite sides of said opening adjacent opposite edge thereof, closing said opening by pressing said opposite sides together with said hook and loop fastener disposed in mating, attached engagement, sewing outer sides of said reinforcing material on said opposite sides so as to add strength to said opening, folding the cuff down so that said top portion is disposed in overlying relation to said bottom portion, aligning a distal rim of said top portion with a lower edge of said bottom portion, sewing seams downwardly on opposite sides of said opening and a bottom seam along said cuff in parallel, spaced relation to said opening, said seams attaching said top portion to said bottom portion, simultaneously stretching the cuff to a maximum expanded position, and sewing said distal rim to said lower edge entirely about the cuff while simultaneously stretching the cuff to said maximum expanded position.

* * * * *